US005671570A

United States Patent [19]

Kaufman et al.

[11] Patent Number: 5,671,570

[45] Date of Patent: Sep. 30, 1997

[54] LOT CONFIGURATION AND BUILDING POSITION AND METHOD FOR RESIDENTIAL HOUSING

[76] Inventors: Mark I. Kaufman; Donald J. Meeks, Jr., both of 15995 N. Barkers Landing, Houston, Tex. 77079

[21] Appl. No.: 666,813

[22] Filed: Jun. 19, 1996

[51] Int. Cl.[6] ..... E02D 19/00

[52] U.S. Cl. ..... 52/169.2; 52/169.3

[58] Field of Search ..... 52/169.2, 169.3

[56] References Cited

U.S. PATENT DOCUMENTS 3,417,526 12/1968 Lawson ..... 52/169.3
3,732,649 5/1973 Mehran ..... 52/169.3

*Primary Examiner*—Christopher T. Kent
*Attorney, Agent, or Firm*—Akin, Gump, Strauss, Hauer & Feld, L.L.P.

[57] ABSTRACT

A residential subdivision having plural adjacent building lots is provided with common property lines between lots which have laterally offset portions extending between front and rear property lines. Residential dwelling units and vehicle garages or carports for each lot are placed a predetermined distance from the respective property lines to conform to regulatory requirements and to provide access to all sides of the dwelling units and garages or carports, respectively, for maintenance and repair without requiring access to adjacent properties. A dwelling unit on one lot and a garage, carport or other structure on an adjacent lot are aligned along a construction reference line placed in a predetermined position extending between front and rear property lines to provide error-free placement of structures on the respective lots. Fences may be provided extending between adjacent dwelling units on adjacent lots and extending along common property lines to the vehicle garages or carports such that a rear or backyard portion of each lot utilizes a somewhat L-shaped portion of an adjacent lot owned by others to provide a large unobstructed backyard space for each lot. The arrangement and method provides improved utilization of land for so-called Z lot subdivisions and ease of locating construction reference lines for proper placement of buildings on adjacent lots.

10 Claims, 3 Drawing Sheets

LOT CONFIGURATION AND BUILDING POSITION AND METHOD FOR RESIDENTIAL HOUSING

FIELD OF THE INVENTION

The present invention pertains to a unique residential or commercial building lot configuration, building position on the lot, and method for locating buildings on adjacent lots.

BACKGROUND

The ever-increasing cost of urban land suitable for residential housing, as well as commercial building locations, has resulted in the development of land subdivision and building designs which provide for so-called "Z" lot developments. Residential housing developments, in particular, which provide Z lot subdivision of individual lots, have many advantages in utilizing available land while providing for individual housing units to be placed spaced apart from each other on adjacent lots. However, a long-standing problem pertaining to subdividing land into individual lots and building placement on the respective lots, concerns providing lot configuration and building placement thereon which will give each owner or resident suitable yard space while providing adequate space for ancillary buildings, such as attached or detached garages or carports, all while also providing for owner access to all sides of structures which are on each lot and meeting regulatory requirements regarding building setback from property lines and compliance with fire codes, for example.

Another problem pertaining to the development of individual adjacent lots in residential, as well as commercial, subdivisions relates to minimizing surveying errors with regard to placement of buildings on adjacent individual lots. Proper location of survey pins or stakes for establishing construction reference lines for properly positioning buildings on individual lots has been a vexatious problem in the construction industry and errors in placement of construction reference lines can cause long delays in seeking variances or exceptions to regulatory requirements, once a building has been improperly placed on a lot, or result in substantial costs for demolition of an improperly placed building and reconstruction of the building in the proper location.

Accordingly, several factors must be taken into consideration when subdividing land for residential housing wherein it is desirable to maximize the utilization of available land by placing residential dwelling units and garages or other vehicle parking or ancillary structures in such a way that will provide aesthetic appeal to the occupants of each dwelling unit, and will provide desirable backyard space, in particular. These factors must be considered while also providing lot configuration and building placement thereon which will conform to regulatory requirements and provide for minimizing surveying errors in properly locating the building footprints during construction of the buildings. It is to these ends that the present invention has been developed.

SUMMARY OF THE INVENTION

The present invention provides an improved lot configuration and building placement thereon, particularly for residential dwelling units and ancillary buildings, including attached and detached garages, carports or parking decks. The invention provides for higher density dwelling placements as a result of ever increasing land costs while still providing large backyard areas for each dwelling unit. The present invention further provides an improved lot configuration and building placement thereon for multiple adjacent lots which are provided with detached dwelling units and attached or detached garages which have vehicle access from an alley on a side of the lots opposite the side which faces a street, roadway or other area.

In accordance with one aspect of the invention, plural adjacent lots are provided which extend between a street, roadway or other area and a second spaced apart roadway or vehicle entry, such as an alley, and which lots may be provided with respective lateral offset portions such that, at least the property lines along the sides of the lots have a somewhat Z-shaped or zig-zag configuration. Residential dwelling units are placed on the lots spaced from the property lines and outbuildings, such as attached or detached garages or carports, are also positioned on each lot spaced from at least the side property lines of each of the lots, respectively. The lot configuration and the building placement thereby provides for access to all sides of the buildings on a particular lot without requiring movement across neighboring lots and while meeting regulatory requirements regarding building setback from the property lines of each lot.

In accordance with another aspect of the present invention, a unique lot configuration and placement of buildings thereon is provided for multiple adjacent lots wherein occupants of dwelling units on respective adjacent lots have greater space available for aesthetic as well as normal residential usage purposes, even though the respective occupants do not own all of the property which they normally use.

Further in accordance with the present invention, a unique arrangement of multiple adjacent residential building lots is provided together with placement of residential dwelling units and garages or carports thereon, respectively, which garages are accessible by a roadway, driveway or alley at the rear of the lots and wherein the garages are placed spaced from the property lines defining adjacent lots.

Still further in accordance with the invention, there is provided a method for placing buildings, such as residential dwelling units and garages or carports, on adjacent lots of a residential subdivision wherein a building construction reference line is established in such a way as to minimize errors in placement of one or more buildings on a particular lot and similar buildings on an adjacent lot. In particular, the method provides for positioning a building a on one lot in alignment with a building on an adjacent lot utilizing the same construction reference line. The survey measurements required for locating the construction reference line are uncomplicated and substantially eliminate errors in locating buildings on adjacent lots.

The present invention still further provides a unique arrangement of property lines for multiple adjacent lots in a subdivided parcel of land having detached residential dwelling units on each lot and garages for respective ones of the dwelling units and wherein the respective properties are fenced in such a way as to maximize usable back yard space for each residential dwelling unit while maintaining the aesthetic appeal of the adjacent dwelling units and the configuration of the subdivision.

Those skilled in the art will further appreciate the above-mentioned features and advantages of the invention together with other superior aspects thereof upon reading the detailed description which follows in conjunction with the drawings.

DESCRIPTION OF THE PREFERRED EMBODIMENTS

Figure 1:
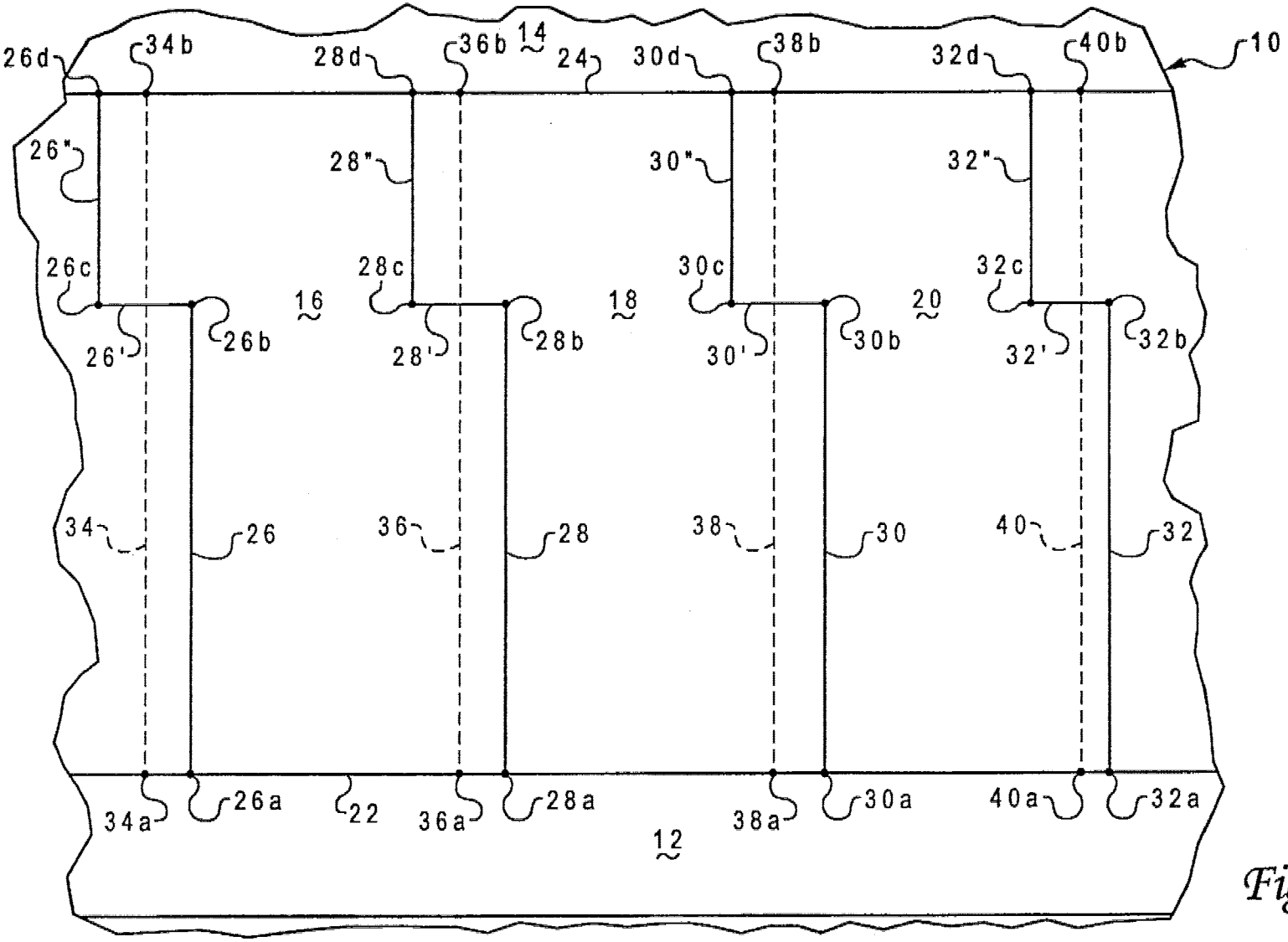
FIG. 1 is a plat of plural residential lots disposed between a street or roadway and a rear driveway or alley, which lots are configured in accordance with the present invention.

In the description which follows like elements are marked throughout the specification and drawing with the same reference numerals, respectively. The drawing figures are not necessarily to scale and the specific configuration of the subdivided lots is, in some respects, exemplary.

Referring to FIG. 1, there is illustrated a plat of a parcel of subdivided land 10 adjacent another parcel of land, such as a street or roadway 12, and disposed between the roadway and a generally parallel rear driveway, alley or other roadway 14, for access to the land parcel by motor vehicles. The particular subdivision of the land parcel 10 in accordance with the invention is such that a plurality of adjacent residential building lots 16, 18 and 20 have been platted, as shown, and which may be disposed between lots or land parcels having a similar or somewhat different configuration. The lots 16, 18 and 20 are delimited by a front property line 22 and a rear property line 24 which is shown parallel to the line 22 but is not necessarily required to be such. The "front" boundary or property line 22 may be adjacent another area, such as a so-called greenbelt area, instead of the street or roadway shown. Moreover, the property lines 22 and 24 are not necessarily required to be substantially straight lines, as shown. The lots 16, 18 and 20 are further delimited by spaced apart side property lines 26, 28, 30 and 32, which are shown parallel, but are not required to be, and which extend from respective property line or surveyor pins or stakes 26*a*, 28*a*, 30*a* and 32*a* on the property line 22, generally normal thereto to respective property line or surveyors pins or stakes 26*b*, 28*b*, 30*b*, and 32*b*.

The property lines of the respective lots 16, 18 and 20 are further defined by portions 26', 28', 30' and 32' extending normal to the property lines 26, 28, 30 and 32, respectively, between surveyor pins 26*b*, 28*b*, 30*b* and 32*b* and respective pins 26*c*, 28*c*, 30*c* and 32*c*. Further portions of the property lines delimiting the lots 16, 18 and 20 are indicated by numerals 26", 28", 30", and 32" and extend between property line survey stakes or pins 26*c* and 26*d*, 28*c* and 28*d*, 30*c* and 30*d*, and 32*c* and 32*d*, respectively. Accordingly, lot 16 is defined by a section of property line 22 between stakes 26*a* and 28*a*, property line 26, 26', 26", a section of property line 24 between stakes 26*d* and 28*d*, and property lines 28", 28' and 28. Lots 18 and 20 are similarly defined by respective sections of property lines 22 and 24 and property lines 28, 28', 28", 30, 30', 30", 32, 32' and 32", respectively. Accordingly, each lot 16, 18 and 20 has a section which is laterally offset from another section of the lot, as shown in FIG. 1. The lots 16 and 18 are of equal width and depth and the lot 20 is of equal depth with respect to lots 16 and 18 but is of reduced width with respect to lots 16 and 18. The specific configuration of lots 16, 18 and 20 with respect to width and depth is somewhat exemplary and the respective property lines 26, 28, 30 and 32 are not required to be substantially parallel to each other.

For sake of clarity, while referring further to FIG. 1, the plat of the land parcel 10 also shows an aspect of a method in accordance with the invention whereby a construction reference line or so called construction "string line" has been located for each of lots 16, 18 and 20 for use as a reference in locating certain buildings to be placed on each of the lots, such as a residential dwelling unit and an attached or detached garage. In accordance with the invention, a side edge of a dwelling unit on one lot and a side edge of an outbuilding, which may be a garage, carport or simply a vehicle parking pad or deck on an adjacent lot, are placed contiguous with one of the construction reference lines illustrated. By way of example, a first construction reference line 34 is defined extending parallel to property line 26 between a pin or stake 34*a* on property line 22 and a pin or stake 34*b* on property line 24. Construction line 34 is preferably positioned equidistant between pins 26*b* and 26*c*. In like manner, construction reference lines 36, 38 and 40 also extend between property lines 22 and 24. Construction reference line 36 extends generally parallel to property line 28, midway between pins 28*b* and 28*c* and is located by pins or stakes 36*a* and 36*b*. In like manner, construction reference line 38 is disposed parallel to property line 30, is located midway between pins 30*b* and 30*c* and extends between locating stakes or pins 38*a* and 38*b*. Finally, construction reference line 40 is disposed extending generally parallel to property line 32, is disposed midway between pins 32*b* and 32*c* and extends between locating pins 40*a* and 40*b*. One advantage of locating the construction reference lines 34, 36, 38 and 40 resides in the fact that a surveyor or construction worker is only required to place the stakes or pins 34*a* and 34*b* defining the location of opposite ends of construction reference line 34, for example, a predetermined distance from the property line pins 26*a* and 26*d*. A cross reference to the location of the construction line 34, for example, may be obtained by measuring the distance between a string defining the line and the surveyor pins 26*b* and 26*c*. Placement of the construction string or reference lines 36, 38 and 40 is done with equal ease by positioning the stakes or pins for these lines at pre-determined distances along the front and rear property lines 22 and 24 from the respective pins defining property lines 28, 30 and 32 while verifying the location of the strings of each reference line by measuring its position with respect to pins 28*b* and 28*c*, 30*b* and 30*c* or 32*b* and 32*c*, respectively.

Figure 2:
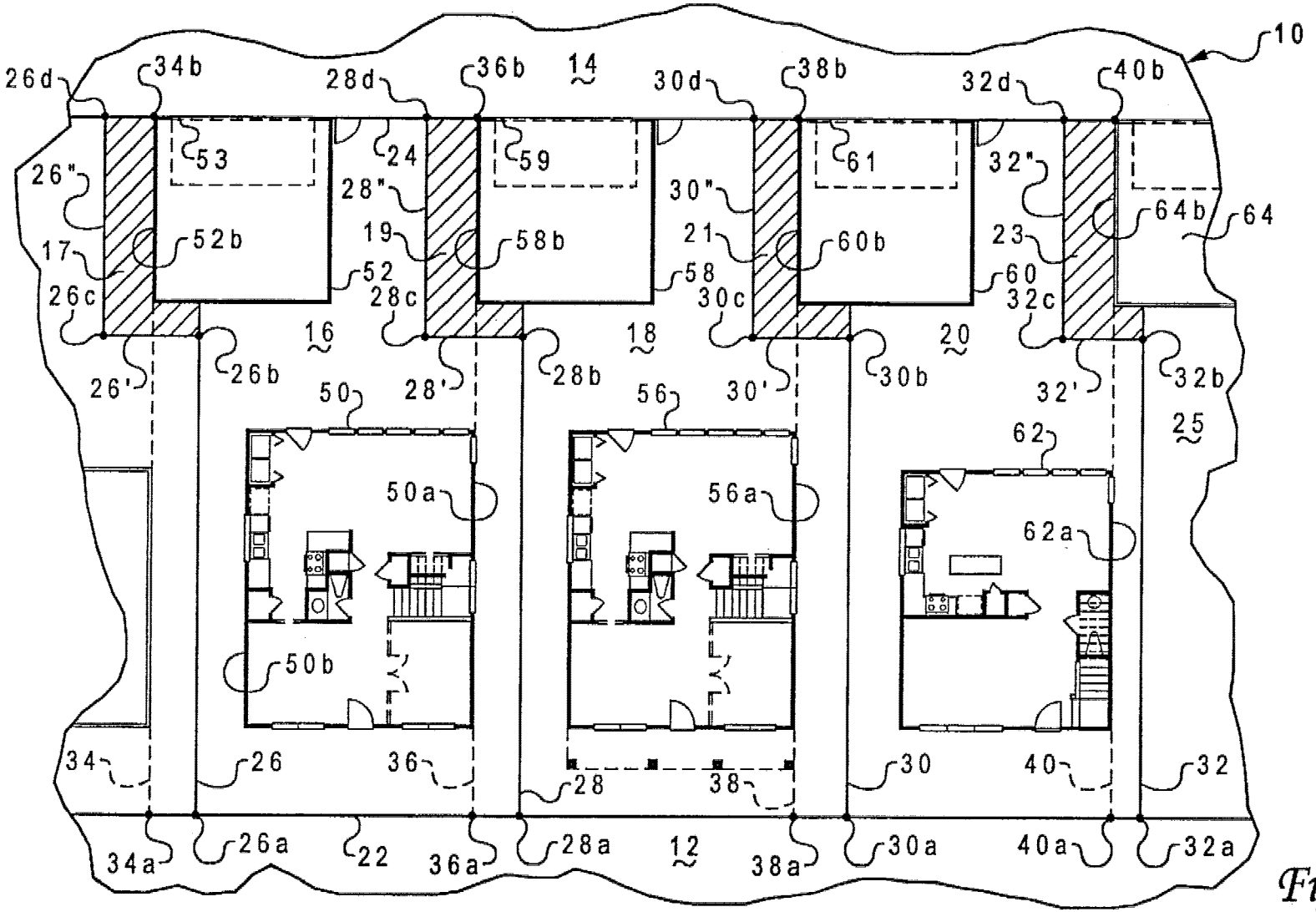
FIG. 2 is a plan view of the lots shown in FIG. 1 illustrating dwelling units and detached rear entry garages disposed on respective ones of the lots in accordance with the invention.

Referring now to FIG. 2, the lots 16, 18 and 20 are shown with respective buildings placed thereon in accordance with the invention. For example, lot 16 is illustrated with a residential dwelling unit structure 50 placed thereon at a required setback from property line 22 and at a requisite distance between property lines 26 and 28. A side edge 50*a* of dwelling unit 50 is shown placed along and contiguous with construction reference line 36. By way of example, the side edges 50*a* and 50*b* of dwelling unit 50 are also spaced equidistant between property lines 26 and 28. Lot 16 also has disposed thereon a rear entry vehicle garage 52 of generally rectangular configuration and having a side edge 52*b* placed along and contiguous with construction reference line 34. In this way, vehicle garage 52, which has a vehicle entry and exit opening 53 facing the alley 14, is also spaced from property line sections 26' and 26". A somewhat L-shaped shaded area of lot 16 is indicated by numeral 17 in FIG. 2. Similar, somewhat L-shaped portions of lots 18 and 20 are indicated in FIG. 2 and designated by numerals 19 and 21, respectively. A fourth, somewhat L-shaped area 23 is actually part of a lot 25 adjacent to lot 20. As mentioned previously, the term garage as used herein may also refer to a carport or merely a concrete pad or other structure for parking vehicles thereon or the "garage" could be a structure used primarily for other purposes.

Referring further to FIG. 2, there is illustrated a residential dwelling unit building 56 disposed on lot 18, of generally rectangular configuration and having a side edge 56*a* extending parallel to and contiguous with construction reference line 38. Dwelling unit 56 is also preferably positioned equidistant between property lines 28 and 30 and is also at least setback from these lines a required regulatory or deed restricted distance. FIG. 2 also shows a detached vehicle garage 58 placed on lot 18 with a vehicle opening 59 facing alley 14 and with at least one side edge 58*b* of garage 58 extending parallel to and contiguous with construction reference line 36. Accordingly, construction reference line 36 may be used to locate building 50 on lot 16 as well as building 58 on lot 18. In like manner, construction reference line 38 is operable for locating building 56 on lot 18 and a building comprising a detached vehicle garage 60 on lot 20. Garage 60 includes a rear opening 61 facing alley 14 and a side edge 60*b* parallel to and contiguous with construction reference line 38.

Still further, as shown in FIG. 2, a residential dwelling unit 62 is disposed on lot 20 and is positioned such that a side edge 62*a* is parallel to and contiguous with construction reference line 40. As further shown in FIG. 2, construction reference line 40 may be used to locate a side edge 64*b* of a building 64 on lot 25. Building 64 may also comprise a vehicle garage similar to the garages 52, 58 and 60.

The placement of the garages 52, 58 and 60 is such that these buildings are spaced from the property lines of the respective lots on which they are situated so that the property owners may have access to all sides of the respective garages for maintenance or repair work, as needed, but for no other reason pursuant to deed restrictions, for example. On the other hand, the L-shaped areas represented by numerals 19, 21 and 23, for example, may be accessible to the occupants (or owners) of lots 16, 18 and 20, respectively, for normal usage of these areas as part of a backyard or lawn area, for example, even though these occupants or owners of lots 16, 18 and 20 are not the owners of the L-shaped areas 19, 21 and 23. Occupancy of the area 19, for example, by the owner or resident of dwelling unit 50 on lot 16 may be dictated by regulations, such as deed restrictions which permit certain uses of this area, and no fence extends along property line portions 28' and 28", for example. In fact, in a preferred arrangement of the buildings on the respective lots 16, 18 and 20, privacy fences extend between the respective dwelling units, generally parallel to the rear facing sides of these buildings, and then along the respective property lines 26, 28, 30 and 32 to be contiguous with the garages 52, 58, 60 and 64, respectively. Fences also, preferably, extend along the rear property line 24 between the respective garages 52, 58, 60 and 64 to give each resident of lots 16, 18 and 20 an enclosed backyard of suitable size.

Figure 3:
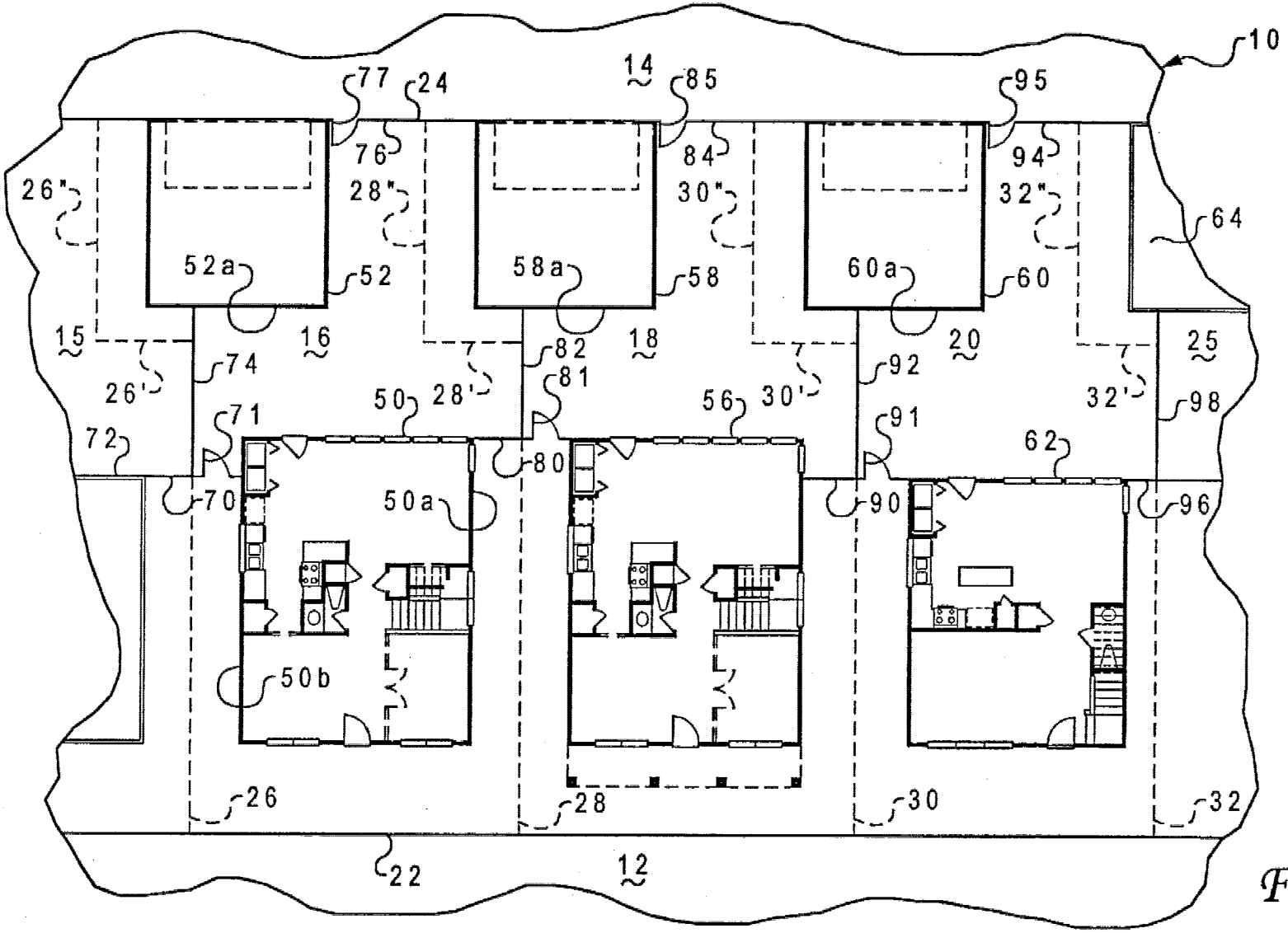
FIG. 3 is a plan view similar to FIG. 2 showing the location of fence lines for the respective lots.

Referring now to FIG. 3, the fences which enclose lot 16 include a fence 70 extending between a building dwelling unit 72 on a lot 15 adjacent to lot 16, which fence extends to side edge 50*b* of building 50. A suitable gate 71 is interposed in the fence 70 on lot 16. A fence 74 also extends along property line 26 to forward side edge 52*a* of garage 52 and a fence 76 extends parallel to, and preferably on, property line 24 between garages 52 and 58 with an access gate 77 interposed therein.

In like manner, a fence 80 extends between buildings 50 and 56, as shown in FIG. 3, having a suitable gate 81 for lot 18 interposed therein. A fence 82 extends along property line 28 between fence 80 and forward side edge 58*a* of garage 58. A fence 84 extends along property line 24 between garages 58 and 60 and has a suitable gate 85 opening to alley 14. A fence 90 extends between buildings 56 and 62 having an access gate 91 for lot 20 interposed therein. A fence 92 extends along property line 30 between fence 90 and forward side edge 60*a* of garage 60 and a fence 94 extends between garage 60 and garage 64 on lot 25 and having a gate 95 interposed therein opening to the backyard of lot 20. Fences 96 and 98, arranged similar to fences 90 and 92, along the opposite side of lot 20 provides closure for the backyard portion of lot 20 between building 62 and property line 32.

Those skilled in the art will appreciate from the foregoing description that the unique lot configuration, building position, and method for locating buildings on respective adjacent lots, in accordance with the invention, provides certain advantages. For example, land suited for residential development may be subdivided in a way wherein land use is maximized while providing for placement of buildings on respective subdivided lots which offer several advantages including those described hereinabove. The specific configurations of the dwelling unit buildings and outbuildings, such as attached or detached garages or carports, may be varied and conventional construction techniques may be utilized for such buildings. By configuring the property lines which are common to the adjacent lots, as described above, and by placing the buildings on the respective lots in the manner set forth herein, each dwelling unit has the appearance of being spaced a suitable distance from each other dwelling unit and rear entry garages, in particular, are placed on each lot in a manner which is aesthetically pleasing and provides maximum usable backyard space for each property owner or dwelling occupant. Moreover, the lots are configured in such a way that the buildings are set back from the actual property lines to conform to regulatory requirements and to provide access to the buildings by the property owners for maintenance and repair.

Although the exemplary lot configurations shown in the drawing figures are generally rectangular, with offset rectangular portions, those skilled in the art will recognize that, as mentioned above, the side property lines 26, 28, 30 and 32, for example, are not required to be parallel to each other. The lots 16, 18 and 20, and so on, may be placed on a curved street, cul-de-sac or otherwise located in such a way that the lots are not strictly rectangular and of equal depth, as shown by example. Moreover, the arrangement and method of the invention may also be utilized for locating non-residential type buildings on adjacent lots configured in accordance with the invention, if desired, although the invention is particularly advantageous for residential developments which are subdivided to provide relatively small lots for each residential unit.

Although a preferred embodiment of the invention has been described in detail herein, those skilled in the art will recognize that various substitutions and modifications may be made to the invention without departing from the scope and spirit of the appended claims.

What is claimed is:

1. A method for locating buildings on adjacent lots, each lot having a front property line and a rear property line and a common property line between said lots, said common property line having laterally offset portions disposed between said front and rear property lines and a section of said common property line extending between said laterally offset portions, comprising the steps of:

placing a construction reference line extending on each lot across said section of common property line and at least partially between said front and rear property lines and spaced from and between said offset portions of said common property line;

placing a building on one of said lots and having a side edge of said building facing one of said laterally offset portions of said common property line and in a predetermined position with respect to said construction reference line; and placing another building on said adjacent lot and having a side edge of said another building facing another of said laterally offset portions of said common property and in a predetermined position with respect to said construction reference line.

2. The method set forth in claim 1 including the step of:

placing said construction reference line parallel to at least one portion of said common property line.

3. The method set forth in claim 1 including the step of:

placing said construction reference line equidistant between said offset portions of said common property line.

4. The method set forth in claim 1 including the step of:

placing one of said buildings to have a side edge of said one building contiguous with said construction reference line.

5. The method set forth in claim 4 including the step of:

placing the other of said buildings on said adjacent lot in such a way as to have a side edge contiguous with said construction reference line whereby both of said buildings are aligned with each other along said construction reference line.

6. The method set forth in claim 1 including the steps of:

extending first and second fences between a first building on one of said lots to respective adjacent side property lines of said one lot;

extending a fence from one of said first and second fences toward a second building on said one lot; and extending a fence between the other of said first and second fences to a building on said adjacent lot to define a space on said one lot between said fences, said buildings on said one lot and said building on said adjacent lot.

7. A method for providing a residential subdivision having a plurality of adjacent lots, an area delimiting a first property line of said lots and a roadway means spaced from said area and delimiting a second property line of said lots spaced from said first property line, comprising the steps of:

extending side property lines defining boundaries between adjacent ones of said lots, respectively, said side property lines each having respective lateral offset portions and property line sections extending between said lateral offset portions, respectively;

placing dwelling units on each of adjacent ones of said lots and disposed at predetermined distances from said side property lines of each of said lots, respectively;

placing vehicle garages on respective ones of said lots in predetermined positions with respect to said sections and said lateral offset portions of said side property lines and said second property line, respectively, so that said vehicle garages and said dwelling units on each of said lots are spaced predetermined distances from said side property lines of each of said lots, respectively, and said vehicle garages having vehicle entry and exit openings facing toward said roadway means, respectively;

extending first fences between adjacent ones of said dwelling units on adjacent ones of said lots, respectively; and extending fences from said first fences to respective ones of said garages on said adjacent lots.

8. The method set forth in claim 7 including the steps of:

extending fences between adjacent ones of said garages, respectively, and along said second property line.

9. In a residential subdivision, a plurality of adjacent contiguous residential properties comprising lots which extend between an area comprising one of a green space and a roadway and an alley spaced from said area, each of said lots being delimited by a first property line at said area and a second property line at said alley, and each of said lots being further defined by third and fourth side property lines dividing said lots and extending between said first property line and said second property line, said third and fourth side property lines dividing said lots each including laterally offset portions, respectively, and property line sections extending between said laterally offset portions;

residential dwelling units disposed on each of said lots at predetermined distances from said property lines, respectively; and vehicle garages positioned adjacent to said second property line, respectively, and having openings for vehicle entry and exit to said alley, each of said garages being spaced from said laterally offset portions and said sections of said third and fourth side property lines, respectively, defining the property lines of each of said lots whereby each of said garages may be accessed by an owner of a lot on which one of said garages is situated, respectively, without traversing an adjacent lot;

first fences extending between said dwelling units on each of said respectively;

a second fence extending between one of said first fences at least partially along a side property line of each lot to said garage disposed on each lot respectively; and a third fence extending from another of said first fences along an opposite side property line of each lot to a vehicle garage on a lot adjacent to said each lot, said second and third fences and said garages defining a useable space for an occupant of a dwelling unit cm each of said lots.

10. The invention set forth in claim 9 including:

a fence extending between garages on adjacent lots and generally parallel to said second property line.

* * * * *